US010135156B2

(12) United States Patent
Prinsloo et al.

(10) Patent No.: US 10,135,156 B2
(45) Date of Patent: Nov. 20, 2018

(54) MULTI-MODE COMPOSITE ANTENNA

(71) Applicant: STELLENBOSCH UNIVERSITY, Stellenbosch (ZA)

(72) Inventors: David Schalk Van der Merwe Prinsloo, Somerset-West (ZA); Petrie Meyer, Stellenbosch (ZA); Rob Maaskant, Göteborg (SE); Marianna Valerievna Ivashina, Göteborg (SE)

(73) Assignee: STELLENBOSCH UNIVERSITY, Stellenbosch (ZA)

( * ) Notice: Subject to any disclaimer, the term of this patent is extended or adjusted under 35 U.S.C. 154(b) by 0 days.

(21) Appl. No.: 15/757,253

(22) PCT Filed: Sep. 4, 2015

(86) PCT No.: PCT/IB2015/056762
§ 371 (c)(1),
(2) Date: Mar. 2, 2018

(87) PCT Pub. No.: WO2017/037516
PCT Pub. Date: Mar. 9, 2017

(65) Prior Publication Data

US 2018/0248272 A1 Aug. 30, 2018

(51) Int. Cl.
*H01Q 25/04* (2006.01)
*H01Q 3/24* (2006.01)
(Continued)

(52) U.S. Cl.
CPC ..... *H01Q 25/04* (2013.01); *H01Q 1/523* (2013.01); *H01Q 3/247* (2013.01); *H01Q 3/26* (2013.01);
(Continued)

(58) Field of Classification Search
CPC ..... H01Q 25/04; H01Q 1/523; H01Q 5/48; H01Q 9/28; H01Q 13/04; H01Q 21/26
See application file for complete search history.

(56) References Cited

U.S. PATENT DOCUMENTS 5,796,372 A 8/1998 Elliot
6,028,563 A * 2/2000 Higgins ..... H01Q 1/246 343/797
(Continued)

FOREIGN PATENT DOCUMENTS

CN 202839949 3/2013
CN 103326117 9/2013
(Continued)

OTHER PUBLICATIONS

Carozzi & Woan, "A Fundamental Figure of Merit for Radio Polarimeters," *IEEE Transactions on Antennas*, 59(6), pp. 2058-2065. (2011).
(Continued)

*Primary Examiner* — Hoang Nguyen
(74) *Attorney, Agent, or Firm* — Norton Rose Fulbright US LLP

(57) ABSTRACT

A multi-mode composite antenna includes two crossed dipole elements each consisting of a bow-tie antenna having two bow-tie antenna segments, and a conductive tube which houses signal transmission lines connected to each bow-tie antenna segment. A conductive flared portion surrounds the conductive tube and forms a monopole element. The bow-tie antenna segments are shaped so that slots extend between each adjacent bow-tie antenna, each slot forming a tapered slot antenna that has a pair of non-linear curved edges that diverge from each other.

13 Claims, 5 Drawing Sheets

(51) Int. Cl.

| | |
|---|---|
| ***H01Q 3/26*** | (2006.01) |
| ***H01Q 9/28*** | (2006.01) |
| ***H01Q 13/04*** | (2006.01) |
| ***H01Q 13/08*** | (2006.01) |
| ***H01Q 25/00*** | (2006.01) |
| ***H01Q 5/48*** | (2015.01) |
| ***H01Q 1/52*** | (2006.01) |
| ***H01Q 21/26*** | (2006.01) |

(52) U.S. Cl.
CPC ..... *H01Q 5/48* (2015.01); *H01Q 9/28* (2013.01); *H01Q 13/04* (2013.01); *H01Q 13/085* (2013.01); *H01Q 21/26* (2013.01); *H01Q 25/001* (2013.01); *H01Q 25/002* (2013.01)

(56) References Cited

U.S. PATENT DOCUMENTS

| | | | | |
|---|---|---|---|---|
| 6,518,931 | B1 | 2/2003 | Sievenpiper | |
| 7,084,833 | B2 | 8/2006 | Pintos et al. | |
| 8,040,288 | B2 | 10/2011 | Baldauf | |
| 8,314,750 | B1 | 11/2012 | Josypenko | |
| 8,350,775 | B2 * | 1/2013 | Obermaier | H01Q 1/246 343/795 |
| 8,390,526 | B1 | 3/2013 | O'Connell et al. | |
| 2008/0036665 | A1 | 2/2008 | Schadler | |
| 2011/0102239 | A1 | 5/2011 | Hino et al. | |

FOREIGN PATENT DOCUMENTS

| | | |
|---|---|---|
| CN | 204118258 | 1/2015 |
| EP | 0762542 | 3/1997 |
| WO | WO 2003/067710 | 8/2003 |
| WO | WO 2011/017198 | 2/2011 |
| WO | WO 2012/151210 | 11/2012 |
| WO | WO 2015/107473 | 7/2015 |

OTHER PUBLICATIONS

English translation of Office Action issued in the corresponding Chinese Application No. 201580082841.4, dated Jul. 17, 2018.

* cited by examiner

MULTI-MODE COMPOSITE ANTENNA

FIELD OF THE INVENTION

This invention relates to an antenna and, more specifically, to a multi-mode composite antenna.

BACKGROUND TO THE INVENTION

In many wireless antenna applications it is desirable to receive or transmit signals from a wide variety of possible angles. However, the radiation pattern of an antenna element is never completely omni-directional, as there is always a direction from which an antenna receives less power than its optimal direction.

Various attempts have been made to combine monopole and dipole antennas so as to create composite antennas that can transmit or receive from more directions with a more even power distribution. The ideal is generally to create a hemispherical radiation pattern for an antenna over a ground plane. However, the combination of a single monopole and dipole do not produce a radiation pattern that is very hemispherical as there are multiple local minima. In addition, collocation of the monopole and dipole is generally a problem and many previous attempts to combine monopoles and dipoles are sub-optimal because they are not accurately collocated.

The applicant's own PCT publication number WO2015107473, which is incorporated by reference in its entirety herein, discloses two embodiments of a composite antenna. The two composite antenna embodiments disclosed combine a monopole and dipole antenna to form a composite antenna that can transmit or receive from more directions with a more even power distribution.

The second antenna embodiment disclosed in WO2015107473, which has sector-shaped dipole arms and a conical extension of a conductive tube, suffers from two drawbacks. A first problem with this antenna is that there is an impedance mismatch between the antenna and the signal transmission lines for one of the excitation modes, namely mode TEM4, in a frequency range of interest. Excitation mode TEM4 is a mode which results in out of phase excitation between adjacent dipole arms, resulting in power radiated between adjacent dipole segments. The impedance of the antenna for this excitation mode is poorly matched compared with the other three excitation modes (TEM1, TEM2 and TEM3) in a frequency range of interest. A poor impedance match results in power being reflected, either reflected back along the signal transmission lines when the antenna is used as a transmitter, or reflected away from the antenna when the antenna is used as a receiver.

A further problem with the disclosed antenna is that fields are induced between inner surfaces of the conical extension, resulting in unwanted interference.

The invention aims to address these and other shortcomings, at least to some extent.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with the invention there is provided a multi-mode composite antenna comprising:

at least two crossed dipole elements extending in a common plane, each dipole element consisting of a bow-tie antenna having two bow-tie antenna segments, a number of signal transmission lines, each signal transmission line connected to one of the bow-tie antenna segments, a conductive tube in which the signal transmission lines extend and which forms a shield for the signal transmission lines, and a conductive flared portion surrounding the conductive tube and flaring outwardly therefrom, the conductive flared portion having an axis which extends perpendicularly to the common plane, wherein the bow-tie antenna segments are shaped so that slots extend between each adjacent bow-tie antenna, each slot forming a tapered slot antenna that has a pair of non-linear curved edges that diverge from each other.

Further features provide for each tapered slot antenna to have a minimum slot width at a central zone where the dipole elements cross each other, a slot length extending from the central zone to an opposite, wide end of the slot, a flare rate defining a rate at which the pair of non-linear curved edges diverge from each other, and a flare width being a maximum width of the slot at its wide end, wherein the minimum slot width, slot length, flare rate and flare width are chosen to reduce an impedance mismatch between the composite antenna and the signal transmission lines within a chosen operating frequency band of the composite antenna.

Further features provide for the slot length and the flare width to both be approximately equal to one third of a wavelength of the lowest frequency in the chosen operating frequency band.

Further features provide for the pair of non-linear curved edges to be exponential curves along at least a portion of their length.

The conductive tube is preferably a right cylindrical conductive tube and is connected to, or configured for connection to, a ground plane.

Further features provide for the conductive flared portion to be conical. In one embodiment, the conical portion is formed by an extension of the conductive tube which has been folded over itself and flares outwardly from the conductive tube. The conical portion may have a free rim or the rim may be connected to, or configured for connection to, a ground plane. In a different embodiment, the conical portion is integral with the conductive tube so that the tube and conical portion together comprise a solid cone with a bore therethrough.

Further features provide for the two bow-tie antenna segments of each dipole element to be generally collinear and to extend in opposite directions along a common plane.

Further features provide for the composite antenna to include two crossed dipole elements providing a total of four bow-tie antenna segments which extend perpendicularly to each other along a common plane with four tapered slot antennas being provided in the slots between each adjacent bow-tie antenna segment, the two dipole elements and the conductive flared portion thereby forming three radiating elements that extend in three mutually perpendicular directions.

In one embodiment, the bow-tie antenna segments are planar and are made from a sheet material. The bow-tie antenna segments may be made as solid conductive plates or may be carried on a supporting non-conductive substrate.

Further features provide for there to be four signal transmission lines each connected to one of the bow-tie antenna segments, and for the signal transmission lines to be connected to a digital beam former.

The invention extends to an antenna array comprising a plurality of multi-mode composite antennas as previously described arranged in a predetermined field configuration.

The invention extends to a method of using a multi-mode composite antenna as herein described, comprising:

applying at least one differential mode excitation to the signal transmission lines to excite the dipole elements and realize a dipole radiation pattern, and applying at least one common mode excitation to the signal transmission lines to excite the dipole elements and realise a monopole radiation pattern between the dipole elements and the conductive flared portion, the composite antenna thereby being capable of a combined monopole and dipole radiation pattern through the application of both differential mode excitation and common mode excitation.

Further features provide for the differential mode excitation and common mode excitation to be applied by a digital beam former that simultaneously excites the dipole elements with four orthogonal transverse electromagnetic excitation modes.

Further features provide for beam-forming weights to be applied to the four orthogonal excitation modes so as to electronically shape the field of view of the composite antenna without the need for the composite antenna to be capable of moving.

Further features provide for the beam-forming weights to be applied to the four orthogonal transverse excitation modes such that a field of view coverage of the composite antenna approximates a hemispherical field of view.

BRIEF DESCRIPTION OF THE DRAWINGS

The invention will now be described, by way of example only, with reference to the accompanying representations in which.

DETAILED DESCRIPTION WITH REFERENCE TO THE DRAWINGS

Figure 1A:
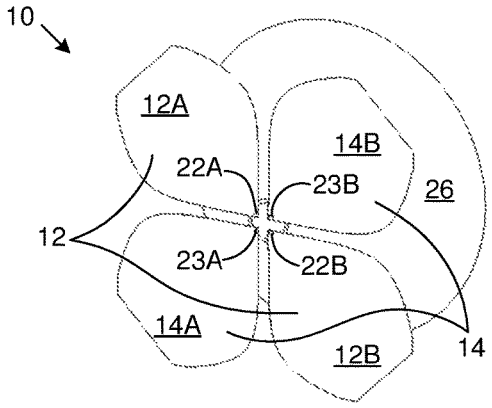
FIG. 1A is a three dimensional view of a first embodiment of a multi-mode composite antenna according to the invention.
Figure 1B:
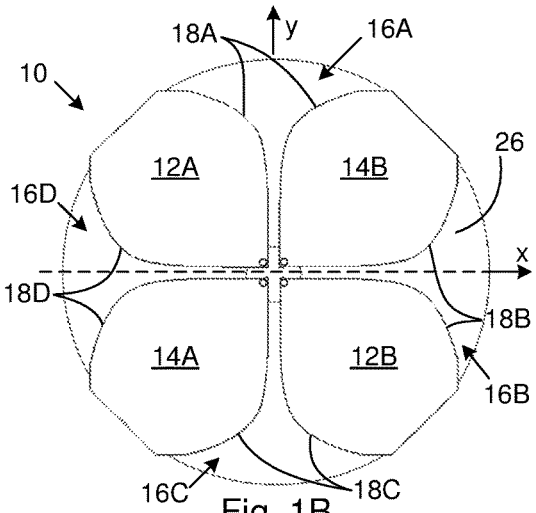
FIG. 1B is a top plan view of the antenna of FIG. 1A.
Figure 1C:
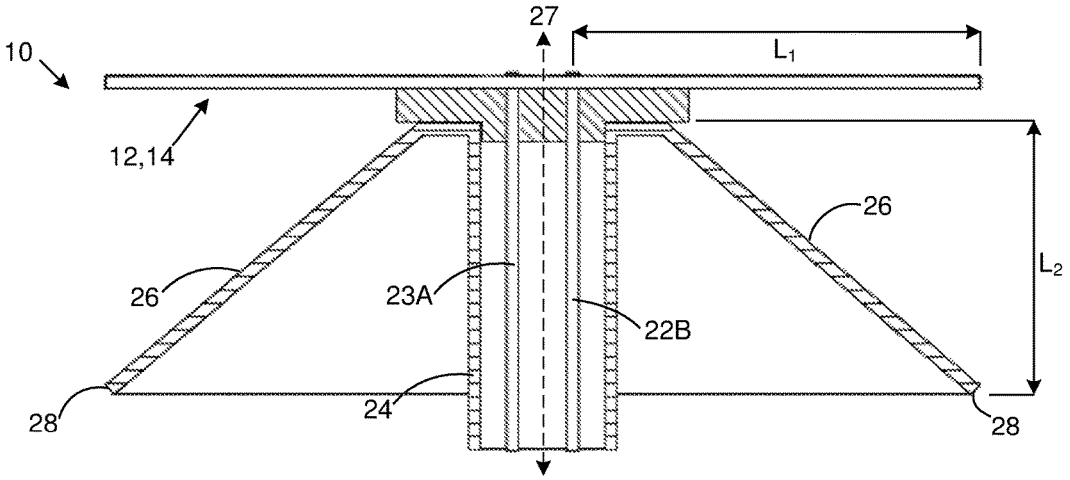
FIG. 1C is a sectional side elevation of the antenna of FIG. 1A along a plane of the x-axis in FIG. 1B.

FIGS. 1A to 1C show a composite multi-mode antenna (10) according to a first embodiment of the invention. The antenna (10) includes first and second crossed dipole elements (12, 14). The first dipole element (12) consists of a bow-tie antenna having two bow-tie antenna segments (12A, 12B) and the second dipole element (14) also consists of a bow-tie antenna having two bow-tie antenna segments (14A, 14B). The two bow-tie antenna segments of each dipole element are generally collinear and extend in opposite directions along a common plane. The dipole elements are crossed perpendicularly to each other with the bow-tie antenna segments (12A, 12B) of the first dipole element (12) extending perpendicularly to the bow-tie antenna segments (14A, 14B) of the second dipole element (14). The bow-tie antenna segments are planar pieces of conductive sheet material such as metal and may be made as solid conductive plates, as shown in FIGS. 1A to 1C, or may be formed by thin layers carried on a supporting non-conductive substrate such as a glass-reinforced epoxy laminate sheet used for printed circuit boards.

As most clearly shown in FIG. 1B, the four bow-tie antenna segments are mounted with slots (16A, 16B, 16C, 16D) extending between adjacent bow-tie antenna segments, each slot forming a tapered slot antenna (16A, 16B, 16C, 16D) that has a pair of non-linear curved edges (18A, 18B, 18C, 18D) that diverge from each other. In this embodiment, the four bow-tie antenna segments are shaped so that the edges (18A, 18B, 18C, 18D) are exponential curves along their length so as to form exponential tapered slot antennas, but other non-linear curves such as logarithmic, exponential or elliptic curves also fall within the scope of this disclosure.

Each of the bow-tie antenna segments (12A, 12B, 14A, 14B) is connected to a separate signal transmission line (22A, 22B, 23A, 23B). The four signal transmission lines extend within a right cylindrical conductive tube (24) that forms a shield for the signal transmission lines and is configured for connection to a ground plane (not shown). The signal transmission lines are connected to a digital beam former (not shown) that is able to apply different excitation modes in a digital domain as will be further discussed herein. The cylindrical conductive tube (24) is shown in an exaggerated scale in FIG. 10 for ease of understanding.

A conductive flared portion (26) surrounds the conductive tube (24) and flares outwardly therefrom. The conductive flared portion (26) has an axis (27) which is perpendicular to the common plane in which the four bow-tie antenna segments extend, the two dipole elements and the conductive flared portion thereby forming three radiating elements that extend in three mutually perpendicular directions.

In the embodiment of FIGS. 1A to 1C, the conductive flared portion (26) is conically shaped and is formed by an extension of the conductive tube (24) which has been folded over itself and flares outwardly from the tube. In that illustrated embodiment, the conical portion (26) has a free rim (28).

The length (L1) of each bow-tie antenna segment (12A, 12B, 14A, 14B) is approximately equal to a height (L2) of the conical portion (26) as measured perpendicularly to the bow-tie antenna segments, to thereby ensure that the dipole radiation pattern and monopole radiation pattern occur at the same frequency. It will be appreciated, however, that deviations from a match in these dimensions may be made to ensure that all modes radiate optimally within an operating frequency band.

Figure 2:
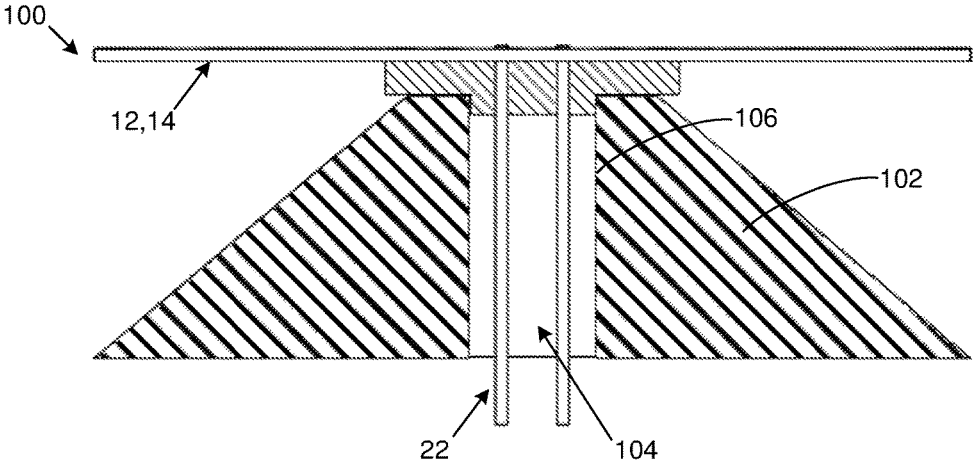
FIG. 2 is a sectional side elevation of a second embodiment of a multi-mode composite antenna according to the invention.

FIG. 2 is a sectional side elevation of a second embodiment of a multi-mode composite antenna (100) along a plane of the x-axis in FIG. 1B. The antenna (100) is similar to the antenna (10) of FIGS. 1A to 1C and like numerals refer to like features, with the only difference being that the conical flared portion is a solid cone (102). A bore (104) extending through the solid cone (102) forms a passageway for the signal transmission lines. In this embodiment, the inner surface of (106) the bore (104) forms the cylindrical tube which shields the transmission lines (22). The crossed bow-tie antenna dipole elements (12, 14) are identical to the embodiment of FIG. 1C.

The solid cone (102) illustrated in FIG. 2 is connected to a ground plane (not shown) in use. The advantage of the solid cone is that the cone is generally easier to manufacture than the folded extension of the conductive tube of the embodiment of FIG. 1C, as it may be machined with less material needing be removed. The solid cone may also be manufactured in other ways, such as by being printed with a three-dimensional printer out of a non-conductive material and then electroplated with a conductive material.

The solid cone (102) results in an elimination of electric fields which may be induced within the hollow cone of FIG. 1C and may lead to spurious interference. The solid conductive cone (102) prevents any such fields from being induced because charges cannot easily build up on the surfaces of the cone as the cone is grounded. It will be appreciated that another means of reducing such fields would simply be to ground the free edge (28) of the conical portion (26) of FIG. 1, and such an embodiment is also within the scope of the invention.

Figure 3A:
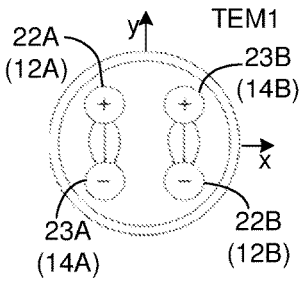
FIGS. 3A to 3D are excitation field distributions for four orthogonal transverse electromagnetic (TEM) excitation modes TEM1 to TEM4.

The four signal transmission lines (22A, 22B, 23A and 23B) are connected to a digital beam former (not shown) which is able to excite the transmission lines. The digital beam former can simultaneously apply four orthogonal transverse electromagnetic (TEM) excitation modes. FIGS. 3A to 3D show excitation field distributions for the four orthogonal transverse electromagnetic excitation modes. In FIG. 3A, the four signal transmission lines (22A, 22B, 23A and 23B) are shown with the corresponding bow-tie antenna segment (12A, 12B, 14A, 14B) excited by each transmission line shown in brackets after the numeral for the applicable signal transmission line.

Figure 4A:
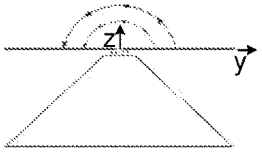
FIGS. 4A to 4D are radiated near-field distributions corresponding the excitation field distributions of FIGS. 3A to 3D.
Figure 5A:
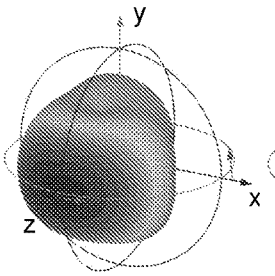
FIGS. 5A to 5D are far-field radiation patterns corresponding to the excitation field distributions of FIGS. 3A to 3D.

A first mode TEM1 is shown in FIG. 3A, and involves exciting the first dipole element (12) with a differential mode excitation using its pair of signal transmission lines (22A, 22B) and also exciting the second dipole element (14) with a differential mode excitation using its pair of signal transmission lines (23A, 23B). The resultant radiated near-field distribution is shown in FIG. 4A and the far-field radiation pattern shown in FIG. 5A. As can be seen, the far-field radiation pattern in FIG. 5A is a dipole-over-ground radiation pattern with the electric-field vector contained in the y-z plane.

Figure 3B:
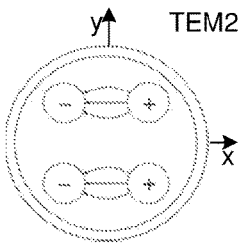
Figure 4B:
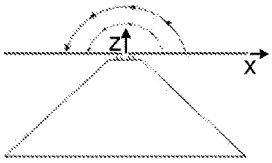
Figure 5B:
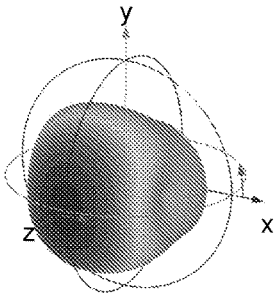

A second mode TEM2 is shown in FIG. 3B, and involves exciting the first and second dipole elements (12, 14), with a differential mode excitation that is orthogonal to the TEM1. The resultant radiated near-field distribution is shown in FIG. 4B and the far-field radiation pattern shown in FIG. 5B. This far-field radiation pattern is a dipole-over-ground radiation pattern with the electric-field vector contained in the x-z plane.

Figure 3C:
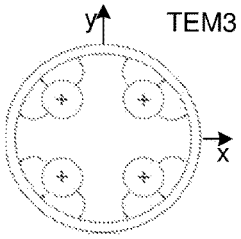
Figure 4C:
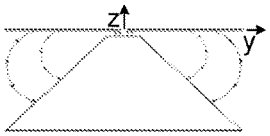
Figure 5C:
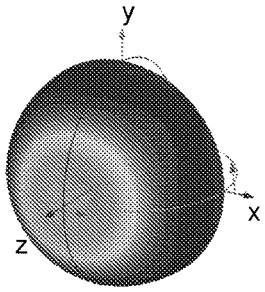

A third mode TEM3 is shown in FIG. 3C, and involves exciting the first dipole elements (12) with a common mode excitation using its pair of signal transmission lines (22A, 22B) and also exciting the second dipole element (14) with an in-phase common mode excitation using its pair of signal transmission lines (23A, 23B). The resultant radiated near-field distribution is shown in FIG. 4C and the far-field radiation pattern shown in FIG. 5C. The far-field radiation pattern is a monopole radiation pattern with the null along the z-axis.

Figure 3D:
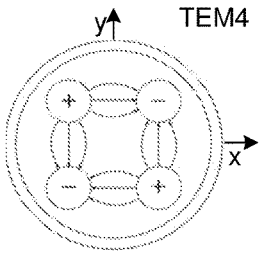
Figure 4D:
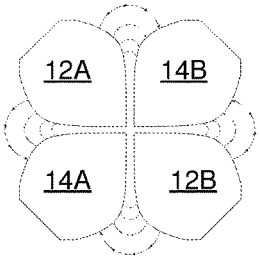
Figure 5D:
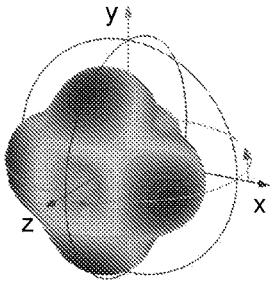

A final fourth mode TEM4 is shown in FIG. 3D, and involves exciting the first dipole element (12) with a common mode excitation and exciting the second dipole element (14) with an out of phase common mode excitation so that adjacent dipole segments (e.g. 12A, 14B) are excited out of phase. The resultant radiated near-field distribution is shown in FIG. 4D and the far-field radiation pattern shown in FIG. 5D. The fields excited by this mode TEM4 propagate within the tapered slot antennas (18A, 18B, 18C, 18D) along the plane of the bow-tie antenna segments. Because of the design of the tapered slot antennas, the magnitudes of the fields radiated by the tapered slot antennas are similar to the magnitude of the fields induced during the monopole excitation mode TEM3, allowing signals with two orthogonal field components to be radiated and discerned by the composite antenna.

By combining all four orthogonal excitation modes TEM1 to TEM4, a near hemispherical field of view coverage can be obtained. By then applying complex beam-forming weights to each of the orthogonal excitation modes (TEM1 to TEM4), the field of view of the composite antenna can be shaped as will be further discussed below.

Experimental Results

Figure 6A:
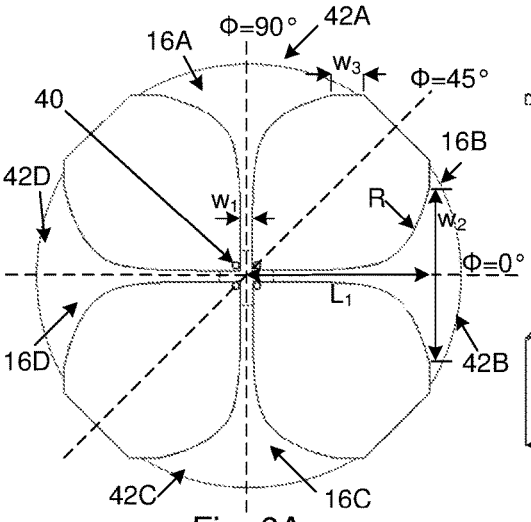
FIGS. 6A and 6B are top plan views and sectional side elevations of a multi-mode composite antenna designed for an operating frequency of between 1 GHz and 1.45 GHz.
Figure 6B:
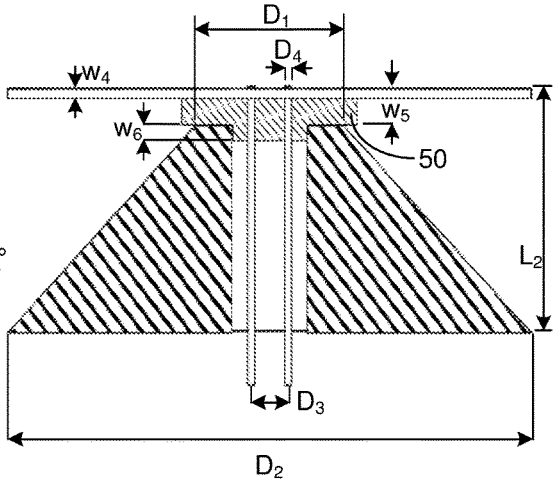

FIGS. 6A and 6B show dimensions of a composite multi-mode antenna designed for a particular operating frequency range. Each tapered slot antenna (16A, 16B, 16C, 16D) has a minimum slot width ($w_1$) at a central zone (40) where the dipole elements cross each other, a slot length ($L_1$) extending from the central zone (40) to an opposite, wide end of each slot (42A, 42B, 42C, 42D), a flare rate (R) defining the rate at which each pair of non-linear curved edges diverge from each other, and a flare width ($w_2$) being a maximum width of the slot (16A, 16B, 16C, 16D) at the wide end (42A, 42B, 42C, 42D). At the wide end of end of each slot, the slot has a small flat taper edge with a taper edge width ($w_3$). As seen in FIG. 6B, the antenna has a height ($L_2$), cone top diameter ($D_1$) and cone bottom diameter ($D_2$). The conductive tube has a conductive tube diameter ($D_3$) and each transmission line has a transmission line feed pin diameter ($D_4$) at the point at which the transmission line is connected to a bow-tie antenna segment. In this embodiment the bow-tie antenna segments are formed on a substrate which has a substrate thickness ($w_4$) and there is a Teflon® spacer (50) which creates a bow-tie antenna to cone gap ($w_5$). The Teflon® spacer has a depth ($w_6$) where it protrudes into the cone and holds the transmission lines in place.

These dimensions are chosen to reduce an impedance mismatch between the composite antenna and the signal transmission lines for mode TEM4 over the operating frequency band of interest, so as to improve the polarization diversity of the composite antenna.

Four main factors determine the impedance matching condition and operating frequency bandwidth for mode TEM4. These are the minimum slot width ($w_1$), the flare rate (R), the slot length ($L_1$), the flare width ($w_2$) and the thickness of the slot defined by the thickness of the planar bow-tie antenna segments (i.e. the thickness of the metallization on the substrate). To decrease the minimum operating frequency, the slot length ($L_1$) as well as the flare width ($w_2$) can be increased, and to increase the minimum operating frequency, the slot length ($L_1$) and the flare width ($w_2$) can be decreased. In one embodiment, the slot length and the flare width are chosen to both be approximately equal to one third of a wavelength of the lowest frequency in the chosen operating frequency band. The determination of the exact parameters for a given frequency range of interest is an iterative design optimization process which involves simulating various designs.

The multi-mode composite antenna of FIGS. 6A and 6B was designed for an operating frequency of between 1 GHz and 1.45 GHz for use in a dense aperture array for radio-astronomy purposes. The dimensions of such an exemplary composite antenna are given in Table 1 below.

TABLE 1

Exemplary Dimensions of a Multi-Mode Composite Antenna with an Operating Frequency of 1 GHz to 1.45 GHz

| Dimension | Value | Unit | Description |
|---|---|---|---|
| $W_1$ | 6 | mm | Minimum slot width |
| $L_1$ | 93 | mm | Slot length |
| R | 0.0964 | $mm^{-1}$ | Flare rate |
| $W_2$ | 96 | mm | Flare width |
| $W_3$ | 10 | mm | Taper edge width |
| $L_2$ | 82 | mm | Composite antenna height |
| $W_4$ | 1.6 | mm | Substrate thickness |
| $W_5$ | 5 | mm | Bow-tie antenna to cone gap |
| $D_1$ | 25 | mm | Cone top diameter |
| $D_2$ | 185 | mm | Cone bottom diameter |
| $D_3$ | 21.5 | mm | Conductive tube diameter |
| $D_4$ | 3.18 | mm | Transmission line feed pin diameter |
| $W_6$ | 2 | mm | Teflon spacer depth |

It will be appreciated that this design can simply be scaled to move the antenna's operating frequency higher or lower. Changing the relative bandwidth or impedance matching, however, requires changing the design parameters, and many different designs may be applicable depending on the desired operating frequency and bandwidth required.

The flare rate (R) is a value which enables the taper profile to be defined as points on a y-axis relative to an x-axis by means of the following formula: $y=c1+c2*e^{Rx}$ where c1 and c2 are constants with a dimension of mm that are solved to ensure the desired widths w1 and w2 for a given length $L_1$, and $e^{Rx}$ is the natural exponential function of the product of R and a value along the x-axis.

Figure 7:
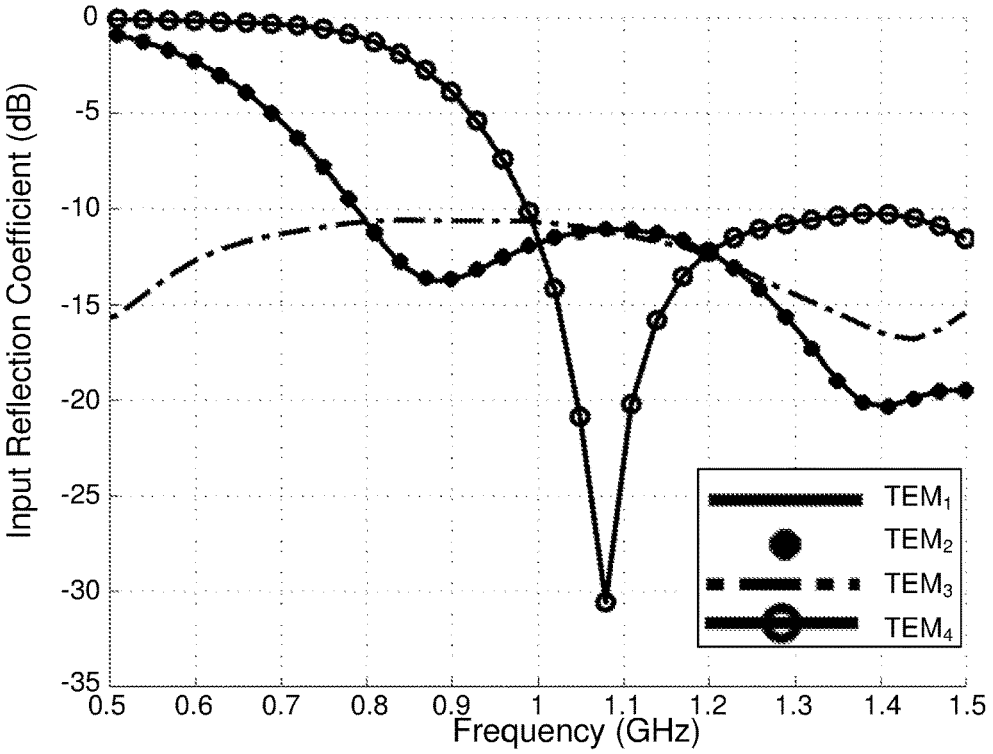
FIG. 7 is a graph showing the magnitude of input reflection coefficients of the antenna of FIGS. 6A and 6B for four excitation modes over a frequency range from 0.5 GHz to 1.5 GHz.

Using CST Microwave Studio®, the response of the antenna for the four orthogonal excitation modes TEM1-TEM4 was simulated over an infinite ground plane. FIG. 7 shows the magnitude of the input reflection coefficients of the four excitation modes over a frequency range from 0.5 GHz to 1.5 GHz. As can be seen, the input reflection coefficients of all four excitation modes are below −10 dB over the frequency range from 1 GHz to 1.5 GHz. Impedance is generally considered matched for input reflection coefficients lower than −10 dB, therefore impedance of all four modes is matched over this frequency range. Despite the fact that these modes remain matched for frequencies above 1.5 GHz, the operating frequency range remains limited to 1.45 GHz due to deformation of the radiated far-field patterns that occurs at higher frequencies. Given the orthogonal nature of the four excitation modes, the simulated coupling between the modes is less than −40 dB across the frequency range of 1 GHz to 1.45 GHz.

The difference in the frequency response observed between mode TEM4 and the other two dipole radiation modes TEM1 and TEM2 is because tapered slot elements radiate optimally for slot lengths much longer than a quarter wavelength of the lowest operating frequency. At the lower operating frequency of the modes TEM1 and TEM2, 800 MHz, the dipoles are both approximately half a wavelength in length and the tapered slot antennas all approximately a quarter wavelength long. Such a short slot length, relative to the operating wavelength, results in a large input impedance and in turn a large impedance mismatch for mode TEM4. At higher frequencies the relative slot lengths increase and the input impedance of the slot antennas decrease, resulting in an improved impedance match for mode TEM4. Since the bow-tie antenna elements and tapered slot antennas are interlinked, the slot lengths will always be approximately a quarter wavelength at the lower operating frequency of modes TEM1 and TEM2. For this embodiment, the lower operating frequency of mode TEM4 will therefore always be higher than that of modes TEM1 and TEM2. The slot length and the flare width are therefore chosen to both be approximately equal to one third of a wavelength of the lowest frequency in the chosen operating frequency band. A 1 GHz signal has a wavelength of approximately 300 mm, therefore both the slot lengths and flare width are chosen to be close to 100 mm. It will, of course be appreciated that the invention is not limited to the slot length and flare width being approximately equal to one third of a wavelength of the lowest frequency in the chosen operating frequency band.

Due to the orthogonal nature of the four transverse excitation modes, the antenna can be used as a single element scanning antenna by beam-forming each excitation mode. In the presence of a ground plane, near hemispherical field of view coverage can be obtained by applying complex beam-forming weights to each excitation mode that results in maximum gain at each scan angle.

Figure 8A:
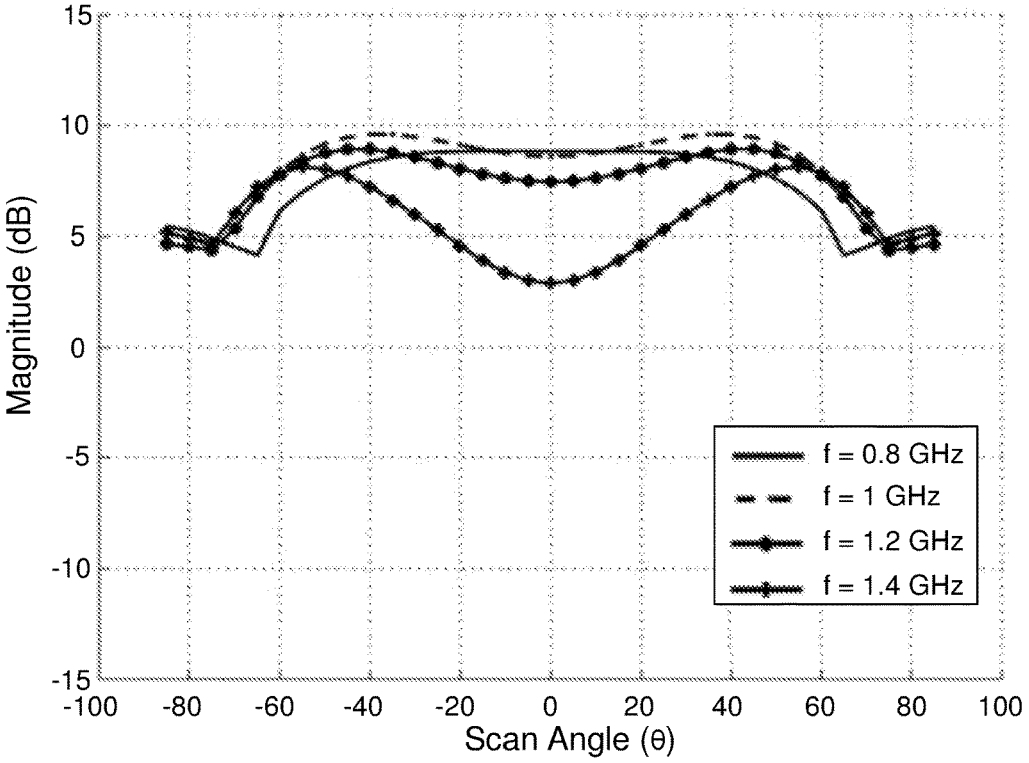
FIGS. 8A and 8B are graphs showing the maximum gain for the antenna of FIGS. 6A and 6B over a range of frequencies and scan angles along two different planes.
Figure 8B:
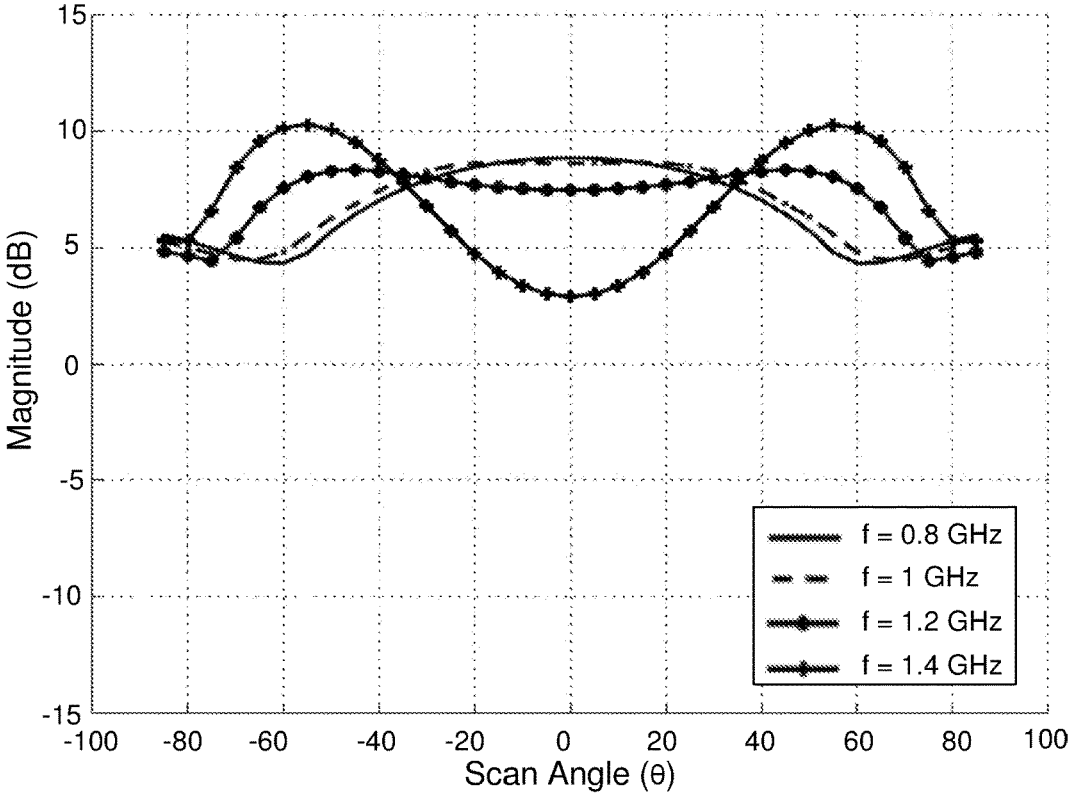

FIG. 8A shows the maximum gain achieved by the composite antenna for frequencies 0.8 GHz, 1 GHz, 1.2 GHz and 1.4 GHz at scan angles between θ=0° to θ=90° in a plane of φ=0° shown in FIG. 6A. FIG. 8B shows a similar graph but in a plane of φ=45° shown in FIG. 6A.

FIG. 8A shows that the gain over the hemispherical field of view coverage at 0.8 GHz varies from approximately 9 dB at θ=0° to 5 dB towards θ=+−60°, a 4 dB variation in gain over the hemispherical scan range. At 1.4 GHz in FIG. 8B, the maximum gain is approximately 10.5 dB at θ=+−60° and the lowest gain is 3 dB towards θ=0°, thus a 7.5 dB variation in gain over the hemispherical scan range. Mode TEM4 radiates at maximum toward scan angles between θ=20° and θ=60°. With this mode mismatched, the gain for these scan angles decreases along with the gain of the dipole radiation patterns, as seen at 0.8 GHz. The higher gain noted for scan angles of 20 to 60 degrees (theta-scan) when comparing the gain at 0.8 GHz to the gain at 1 GHz to 1.4 GHz, is only due to the power radiated by mode TEM4. Note that the lower gain noted at higher frequencies toward θ=0°, does not depend on mode TEM4; this is the power radiated by the dipoles (modes TEM1 and TEM2) that decrease (toward θ=0°) with frequency. For frequencies above 1

GHz, the increased gain due to the improved matching of mode TEM4 can therefore clearly be noted in FIG. 8A at scan angles (θ) between 20° and 60° from zenith. The deformation of the radiated far-field patterns excited by modes TEM1 and TEM2 is seen to result in a reduction in gain toward zenith (θ=0°) at 1.4 GHz. However, despite the lower gain toward zenith at the higher end of the frequency band, the composite antenna is still able to detect two orthogonal field components.

The polarimetric performance of the composite antenna was assessed according to known techniques by determining the Intrinsic Cross-Polarization Ratio (IXR) of the antenna and using it as a figure of merit. An explanation of the IXR is given in T. Carozzi and G. Woan, "A fundamental figure of merit for radio polarimeters," *IEEE Trans. Antennas Popag*., vol. 59, no. 6, pp. 2058-2064, June 2011. The IXR of the antenna was solved at each scan angle over a hemispherical field of view coverage. With mode TEM4 suppressed at 1 GHz, the IXR values obtained reduced to zero for scan angles larger than 65° from zenith. In comparison, the improved impedance match when mode TEM4 was included resulted in IXR values greater than 10 dB up to scan angles of 80° along the plane of ϕ=0°. A similar result was observed at 1.2 GHz, where the availability of excitation mode TEM4 is seen to result in IXR values greater than 10 dB up to scan angles of 80° along the plane of ϕ=0°. IXR values slightly below 10 dB were obtained in the diagonal plane of ϕ=45° at scan angles between 50° and 70°. This reduction in IXR is attributed to the larger difference in the power radiated by modes TEM1, TEM2 and TEM3 at these scan angles.

The invention integrates and co-locates tapered slot antennas with two orthogonal bow-tie dipole antennas and a conical flared portion that forms a monopole element. The integration of tapered slot antenna elements between each of the adjacent bow-tie antenna segments results in improved impedance matching for excitation mode TEM4. The improved input match of this excitation mode allows for an additional beam-forming degree of freedom to maximize the gain, sensitivity as well as the polarimetric performance of the antenna over a hemispherical field of view coverage. The integrated tapered slot antennas improve the polarimetric performance of the composite multi-mode antenna at larger scan angles. Using the IXR as a figure of merit, the composite multi-mode antenna was able to achieve IXR values above 10 dB up to a scan angle of 80° from zenith. This means that the composite multi-mode antenna was found to be able to discern the polarization state of an incident electromagnetic wave front up to scan angles of 80° from zenith. Because the tapered slot antenna elements are oriented perpendicularly to the conical portion, polarization discrimination capability is improved even at small elevation angles.

The solid conical embodiment simplifies manufacturing and provides improved stability to the composite multi-mode antenna. Implementing a solid cone connected to a ground plane also suppresses the excitation of spurious resonances observed in the hollow conical portion of the other embodiment.

The composite antenna can be integrated in micro base transceiver stations (BTS) for wireless communication networks, or as a 4-port multiple-input and multiple-output (MIMO) antenna, both in line-of-sight and rich isotropic multipath (RIMP) environments. The antenna can be mounted on walls while still being able to intercept signals from various directions and polarizations which may be due to multipath effects, so as to maintain high data throughput rates. The antenna diversity achieved by the multiple orthogonal excitation modes allows for the use of a single multi-mode antenna in multipath MIMO applications.

The multi-mode composite antenna described can be made in different sizes for different applications. Table 2 below illustrates two exemplary applications for a multi-mode composite antenna, together with an illustrative width of each antenna (i.e. the combined length of the two bow-tie antenna segments of a dipole element), height of the antenna as measured perpendicularly to the dipole element, and approximate bandwidth of the antenna. The acronyms under the heading "Application" are well known to those in the field of wireless telecommunication. GSM stands for Global System for Mobile Communication and is a cellular telephone technology. UMTS is Universal Mobile Telecommunications System, WCDMA is Wideband Code Division Multiple Access and LTE is Long Term Evolution. Of course, numerous other applications exist and the invention is not limited to any of these applications.

TABLE 2

Approximate Dimensions of a Multi-Mode Composite Antenna for Various Applications

| Application | Antenna Height (mm) | Antenna Width (mm) | Approximate Bandwidth |
|---|---|---|---|
| GSM1800/1900, UMTS/3G, WCDMA | 39 | 78 | 25% |
| LTE1800, LTE2300 | 36 | 72 | 35% |

Figure 9:
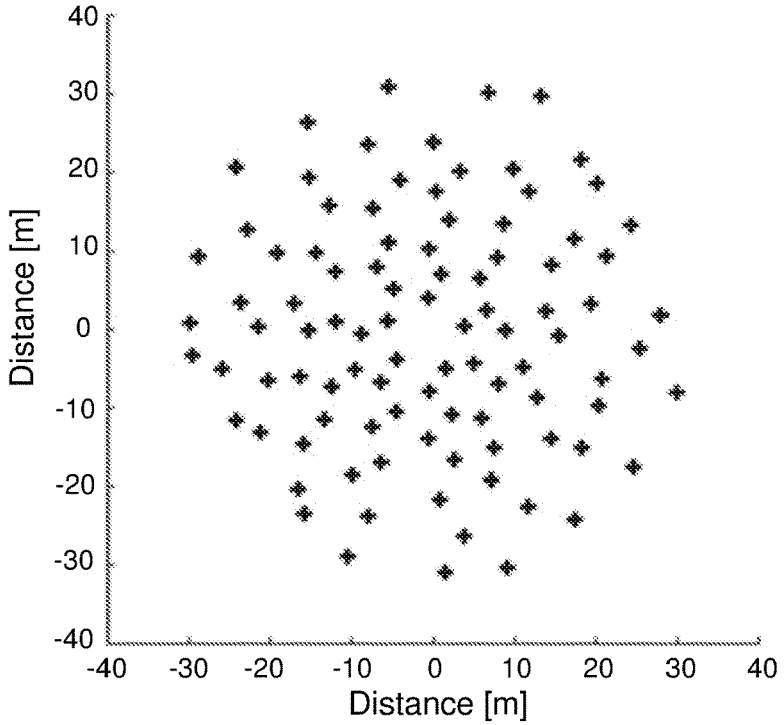
FIG. 9 is an exemplary field configuration layout of an array of antennas according to the invention.
Figure 10:
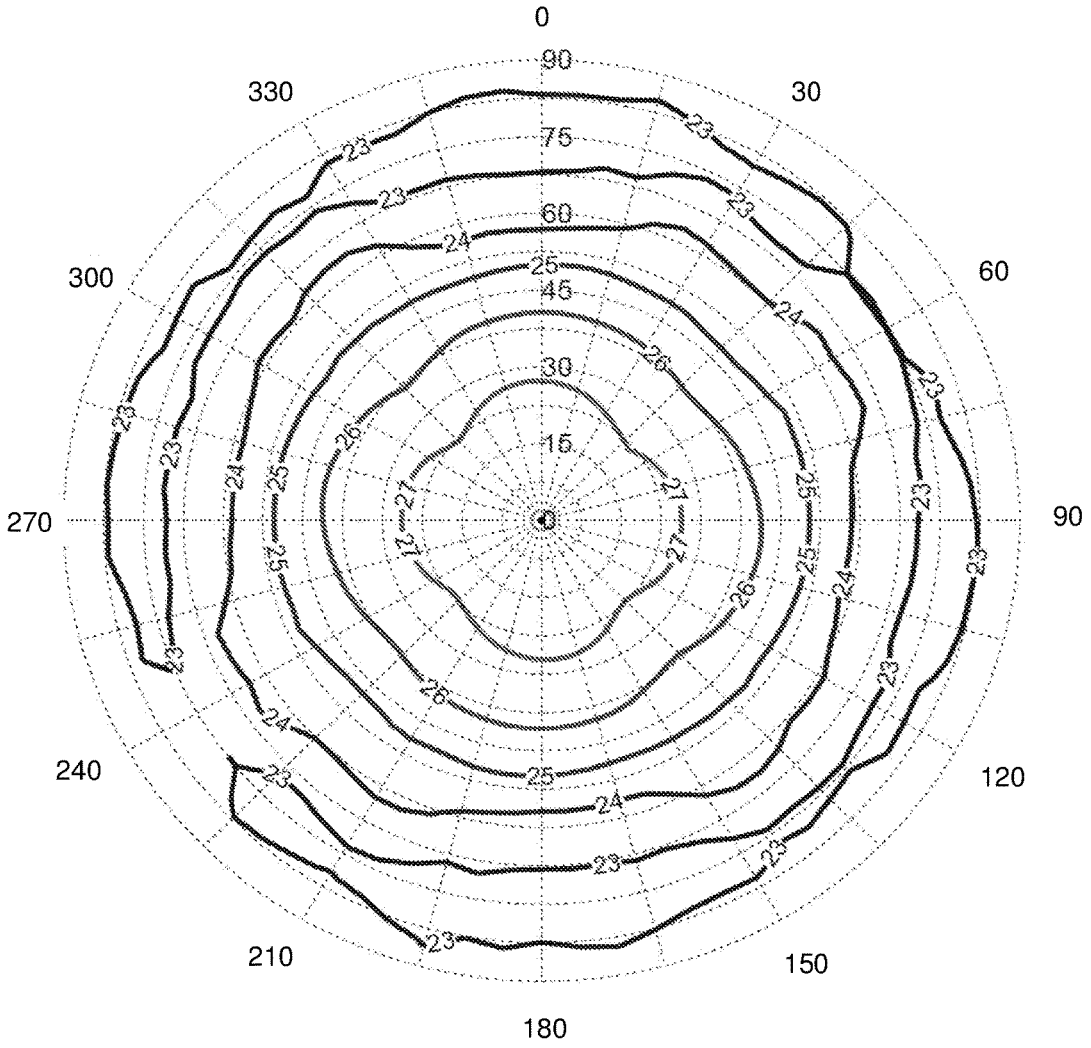
FIG. 10 is a diagram showing the gain of the antenna array of FIG. 9 over a hemispherical field of view when beam-forming to ensure near-axisymmetric gain over the hemispherical field of view.

While the multi-mode composite antenna described can be used as a single antenna it can also be arranged into an antenna array which includes a plurality of antennas arranged in a predetermined field configuration. FIG. 9 shows an exemplary field configuration for an array of multi-mode composite antennas. The illustrated field configuration is based on a 96 element array and is arranged in an irregular configuration. The configuration is based on an existing demonstrator phased antenna array radio telescope known as LOFAR (Low Frequency Array) and is chosen to enable comparison of an antenna array of the invention with existing antennas which are purely differential, i.e. dipole based. The field configuration of FIG. 9 is designed to observe at VHF (Very High Frequency) bands. In this illustration, the size of the antennas are scaled to achieve a resonant frequency of 55 MHz, which requires an antenna height of approximately 1.3 m and width (i.e. the length of two antenna arms) of about 2.6 m. By applying complex beam-forming weights to the four orthogonal excitation modes (TEM1 to TEM4) as previously described, the gain of the antenna array can be maximized at each scan angle. FIG. 10 is a diagram showing the gain of the multi-mode composite antenna array of FIG. 9 over a hemispherical field of view when beam-forming to ensure near-axisymmetric gain over the hemispherical field of view.

The antenna array could find particular application in radio astronomy applications. In such applications, the antenna array is used as a radio telescope where scanning all the way down to the horizon in specific directions can be done by electronically shaping the field of view of the composite antennas without the need for the antennas to be capable of physically moving and tracking a target.

The invention is not limited to the described embodiments and numerous modifications are included within the scope of the invention. For example, the composite antenna does not need to have only two dipole elements but could include three, four or any higher number of dipole elements. Numerous choices exist for the material of construction and the means for exciting the dipole elements.

Throughout the specification and claims unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A multi-mode composite antenna comprising:

at least two crossed dipole elements extending in a common plane, each dipole element consisting of a bow-tie antenna having two bow-tie antenna segments, a number of signal transmission lines, each signal transmission line connected to one of the bow-tie antenna segments, a conductive tube in which the signal transmission lines extend and which forms a shield for the signal transmission lines, and a conductive flared portion surrounding the conductive tube and flaring outwardly therefrom, the conductive flared portion having an axis which extends perpendicularly to the common plane, wherein the bow-tie antenna segments are shaped so that slots extend between each adjacent bow-tie antenna, each slot forming a tapered slot antenna that has a pair of non-linear curved edges that diverge from each other, and further wherein each tapered antenna has a minimum slot width at a central zone where the dipole elements cross each other, a slot length extending from the central zone to an opposite, wide end of the slot, a flare rate defining a rate at which the pair of non-linear curved edges diverge from each other, the flare starting from the central zone and extending to the wide end of the slot, and a flare width being a maximum width of the slot at its wide end, wherein the minimum slot width, slot length, flare rate and flare width are chosen to reduce an impedance mismatch between the composite antenna and the signal transmission lines within a chosen operating frequency band of the composite antenna.

2. A multi-mode composite antenna as claimed in claim 1, wherein the slot length and the flare width are both approximately equal to one third of a wavelength of the lowest frequency in the chosen operating frequency band.

3. A multi-mode composite antenna as claimed in claim 1, wherein the pair of non-linear curved edges are exponential curves along at least a portion of their length.

4. A multi-mode composite antenna as claimed in 1, wherein the conductive tube is a right cylindrical conductive tube and is connected to, or configured for connection to, a ground plane.

5. A multi-mode composite antenna as claimed in claim 1, wherein the conductive flared portion is conical and the conical portion is formed by an extension of the conductive tube which has been folded over itself and flares outwardly from the conductive tube.

6. A multi-mode composite antenna as claimed in claim 1, wherein the conductive flared portion is conical and the conical portion is integral with the conductive tube so that the tube and conical portion together comprise a solid cone with a bore therethrough.

7. A multi-mode composite antenna as claimed in claim 1, wherein the antenna includes two crossed dipole elements providing a total of four bow-tie antenna segments which extend perpendicularly to each other along a common plane, with four tapered slot antennas being provided in the slots between each adjacent bow-tie antenna segment, the two dipole elements and the conductive flared portion thereby forming three radiating elements that extend in three mutually perpendicular directions.

8. A multi-mode composite antenna as claimed in claim 1, wherein the bow-tie antenna segments are made planar and made from a sheet material that is carried on a supporting non-conductive substrate.

9. A multi-mode composite antenna as claimed in claim 1, wherein there are four signal transmission lines each connected to one of the bow-tie antenna segments, and the signal transmission lines are connected to a digital beam former.

10. An antenna array comprising a plurality of multi-mode composite antennas as claimed in claim 1 arranged in a predetermined field configuration.

11. A method of using a multi-mode composite antenna as claimed in claim 1, comprising:

applying at least one differential mode excitation to the signal transmission lines to excite the dipole elements and realize a dipole radiation pattern, and applying at least one common mode excitation to the signal transmission lines to excite the dipole elements and realise a monopole radiation pattern between the dipole elements and the conductive flared portion, the composite antenna thereby being capable of a combined monopole and dipole radiation pattern through the application of both differential mode excitation and common mode excitation.

12. A method as claimed in claim 11, wherein the differential mode excitation and common mode excitation is applied by a digital beam former that simultaneously excites the dipole elements with four orthogonal transverse electromagnetic excitation modes.

13. A method as claimed in claim 12, wherein the beamforming weights are applied to the four orthogonal transverse excitation modes so as to electronically shape the field of view of the composite antenna without the need for the composite antenna to be capable of moving.

* * * * *